US011085444B2

(12) United States Patent
Yamazaki et al.

(10) Patent No.: US 11,085,444 B2
(45) Date of Patent: Aug. 10, 2021

(54) SCROLL-TYPE FLUID MACHINE

(71) Applicant: Hitachi Industrial Equipment Systems Co., Ltd., Tokyo (JP)

(72) Inventors: Shumpei Yamazaki, Tokyo (JP); Yoshiyuki Kanemoto, Tokyo (JP); Sho Watanabe, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 174 days.

(21) Appl. No.: 16/313,736

(22) PCT Filed: Jul. 7, 2016

(86) PCT No.: PCT/JP2016/070182

§ 371 (c)(1),
(2) Date: Dec. 27, 2018

(87) PCT Pub. No.: WO2018/008132

PCT Pub. Date: Jan. 11, 2018

(65) Prior Publication Data

US 2020/0309125 A1 Oct. 1, 2020

(51) Int. Cl.
*F01C 1/02* (2006.01)
*F04C 18/02* (2006.01)
(Continued)

(52) U.S. Cl.
CPC ..... *F04C 18/0215* (2013.01); *F04C 23/008* (2013.01); *F04C 27/006* (2013.01);
(Continued)

(58) Field of Classification Search
CPC ..... F04C 18/0215; F04C 23/008; F04C 15/0096; F04C 27/005; F04C 29/04;
(Continued)

(56) References Cited

U.S. PATENT DOCUMENTS

2002/0102174 A1 8/2002 Suefuji et al.
2005/0232799 A1 10/2005 Sato
(Continued)

FOREIGN PATENT DOCUMENTS

CN 102817843 A 12/2012
CN 204553219 U 8/2015
(Continued)

OTHER PUBLICATIONS

International Search Report (PCT/ISA/210) issued in PCT Application No. PCT/JP2016/070182 dated Oct. 4, 2016 with English translation (five (5) pages).
(Continued)

*Primary Examiner* — Deming Wan
(74) *Attorney, Agent, or Firm* — Crowell & Moring LLP

(57) ABSTRACT

Provided is a scroll-type fluid machine that prevents wear of the parts of the fluid machine and improves the reliability thereof by reducing the amount of dust that reaches a face seal. The present invention comprises a revolving scroll that includes an end plate and a lap part provided to the end plate, and that moves in a revolving manner; a fixed scroll that includes an end plate, a lap part provided to the end plate such that a compression chamber is formed between itself and the lap part of the revolving scroll, and a flange that opposes the end plate of the revolving scroll; and a face seal that is provided between the flange of the fixed scroll and the end plate of the revolving scroll, and that seals a space between the fixed scroll and the revolving scroll, with the scroll-type fluid machine further comprising a shield part that suppresses dust from reaching the face seal from the outside in the radial direction.

20 Claims, 8 Drawing Sheets

(51) Int. Cl.

| | |
|---|---|
| ***F04C 23/00*** | (2006.01) |
| ***F04C 15/00*** | (2006.01) |
| ***F01C 21/06*** | (2006.01) |
| ***F04C 27/00*** | (2006.01) |
| ***F04C 29/04*** | (2006.01) |
| ***F04C 29/00*** | (2006.01) |

(52) U.S. Cl.
CPC ..... *F04C 29/04* (2013.01); *F04C 2210/221* (2013.01); *F04C 2240/30* (2013.01); *F04C 2240/50* (2013.01)

(58) Field of Classification Search
CPC .. F04C 29/0092; F04C 18/02; F04C 18/0253; F01C 21/06; F01C 1/0253
See application file for complete search history.

(56) References Cited

U.S. PATENT DOCUMENTS

| | | | | |
|---|---|---|---|---|
| 2007/0224072 | A1 | 9/2007 | Ishikawa et al. | |
| 2011/0300012 | A1 | 12/2011 | Fujioka et al. | |
| 2012/0189480 | A1* | 7/2012 | Yamazaki ..... | F04C 18/0253 418/55.2 |
| 2012/0315174 | A1 | 12/2012 | Iwano et al. | |
| 2014/0119970 | A1* | 5/2014 | Kobayashi ..... | F04C 18/0215 418/55.4 |

FOREIGN PATENT DOCUMENTS

| | | | |
|---|---|---|---|
| CN | 103994069 | B | 4/2016 |
| EP | 1 837 525 | A2 | 9/2007 |
| JP | 11-82330 | A | 3/1999 |
| JP | 2000-291572 | A | 10/2000 |
| JP | 2000-337275 | A | 12/2000 |
| JP | 2002-81388 | A | 3/2002 |
| JP | 2002-213376 | A | 7/2002 |
| JP | 2005-307770 | A | 11/2005 |
| JP | 2012-255409 | A | 12/2012 |

OTHER PUBLICATIONS

Japanese-language Written Opinion (PCT/ISA/237) issued in PCT Application No. PCT/JP2016/070182 dated Oct. 4, 2016 (seven (7) pages).
Japanese-language Office Action issued in counterpart Japanese Application No. 2018-525899 dated Dec. 3, 2019 with English translation (eight (8) pages).
Extended European Search Report issued in European Application No. 16908176.7 dated Jan. 21, 2020 (seven (7) pages).
Chinese-language Office Action issued in counterpart Chinese Application No. 201680086988.5 dated Jun. 4, 2019 with English translation (13 pages).
English translation of document B2 (JP 2000-337275 A previously filed on Dec. 27, 2018) (18 pages).

* cited by examiner

SCROLL-TYPE FLUID MACHINE

TECHNICAL FIELD

The present invention relates to a scroll-type fluid machine.

BACKGROUND ART

A scroll-type fluid machine as set forth in PTL 1 has achieved improved seal performance of a dust seal by doubling a terminal end of the dust seal and fitting the doubled terminal end in a dust seal groove.

CITATION LIST

Patent Literature

PTL 1: Japanese Patent Application Laid-Open No. 2005-307770

SUMMARY OF INVENTION

Technical Problem

The scroll-type fluid machine is provided with an annular face seal (dust seal) between a fixed scroll and a revolving scroll in order to prevent a problem that dust invades a compression chamber or expansion chamber from outside, causing wear of a sealing material and components in the machine.

In the scroll-type fluid machine of PTL 1, a face seal has its terminal end doubled and fitted in a dust seal groove such that the face seal is improved in the seal performance at the end thereof without reducing the productivity of the machine. This structure is not equipped with a measure against the external dust reaching the face seal, leading to a problem of the dust invading from the outside through a seal surface and a problem of wear of the face seal itself caused by the dust.

In view of the above, the present invention has an object to provide a scroll-type fluid machine that prevents the wear of the parts of the fluid machine and improves the reliability thereof by reducing the amount of dust that reaches the face seal.

Solution to Problem

According to an aspect of the present invention for achieving the above object, a scroll-type fluid machine includes: a revolving scroll which includes an end plate and a lap part disposed at the end plate, and makes a revolving motion; a fixed scroll which includes an end plate, a lap part disposed at the end plate and forming a compression chamber between itself and the lap part of the revolving scroll, and a flange opposed to the end plate of the revolving scroll; and a face seal disposed between the flange of the fixed scroll and the end plate of the revolving scroll and sealing a clearance between the fixed scroll and the revolving scroll, and has a configuration wherein a shield part is provided on the end plate of the revolving scroll or the end plate of the fixed scroll for preventing dust from reaching the face seal from outside in a radial direction.

According to another aspect of the present invention, a scroll-type fluid machine includes: a revolving scroll which includes an end plate and a lap part disposed at the end plate, and makes a revolving motion; a fixed scroll which includes an end plate, a lap part disposed at the end plate and forming a compression chamber between itself and the lap part of the revolving scroll, and a flange opposed to the end plate of the revolving scroll; and a face seal disposed between the flange of the fixed scroll and the end plate of the revolving scroll and sealing a clearance between the fixed scroll and the revolving scroll, and has a configuration wherein a cooling air passage for distribution of cooling air is formed on the opposite side of the end plate of the revolving scroll from that formed with the lap part, and the shield part is provided on the surface of the flange of the fixed scroll with the face seal at place radially outward from the face seal or at place laterally of the flange, and the shield part protrude in a direction away from the surface of the flange.

Advantageous Effects of Invention

The present invention can provide the scroll-type fluid machine that prevents the wear of the parts of the fluid machine and improves the reliability thereof by reducing the amount of dust that reaches the face seal.

DESCRIPTION OF EMBODIMENTS

Figure 1:
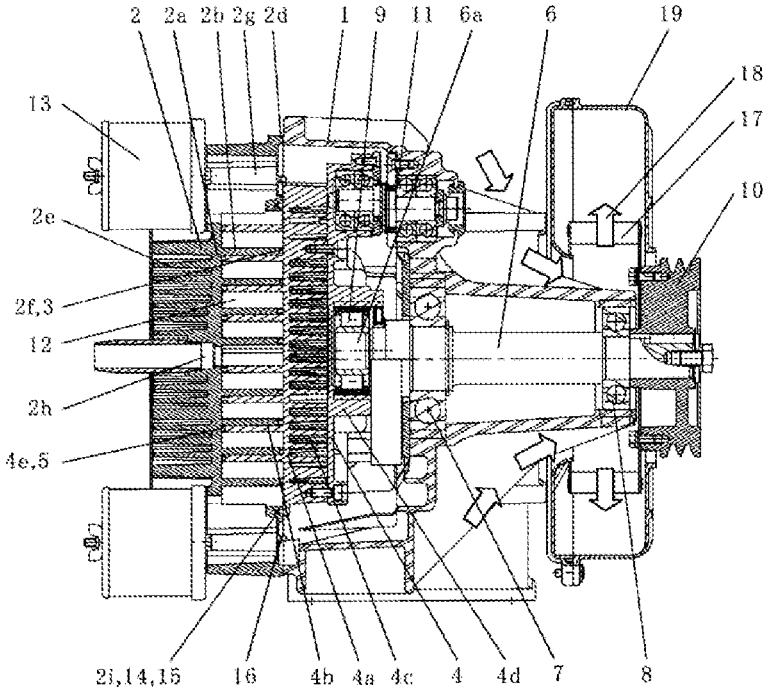
FIG. 1 is a vertical sectional view showing a scroll-type fluid machine according to Example 1 hereof.

A scroll-type fluid machine according to an embodiment of the present invention is described as below with reference to a scroll-type air compressor as an example thereof and the accompanying drawings. Throughout the figures illustrating the examples hereof, equal or similar reference numerals are principally assigned to equal or similar components, which are explained only once in most cases to avoid repetitions.

EXAMPLE 1

FIG. 1 is a vertical sectional view showing a scroll-type fluid machine according to Example 1 hereof.

Figure 2:
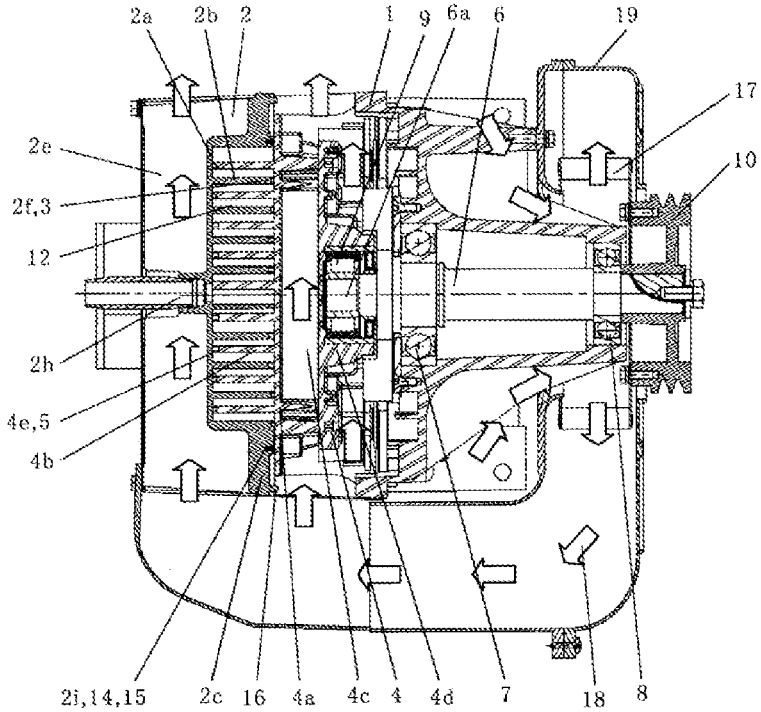
FIG. 2 is a transverse sectional view showing the scroll-type fluid machine according to Example 1 hereof.

FIG. 2 is a transverse sectional view showing the scroll-type fluid machine according to Example 1 hereof.

Figure 3:
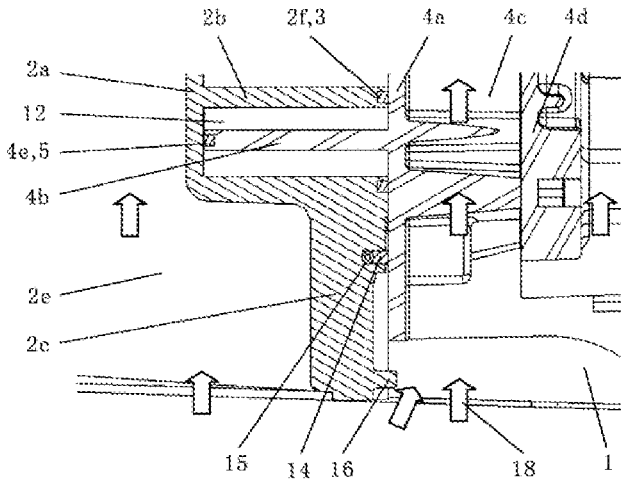
FIG. 3 is an enlarged view showing an area around a face seal of the scroll-type fluid machine according to Example 1 hereof.

FIG. 3 is a fragmentary enlarged view of FIG. 2.

Figure 4:
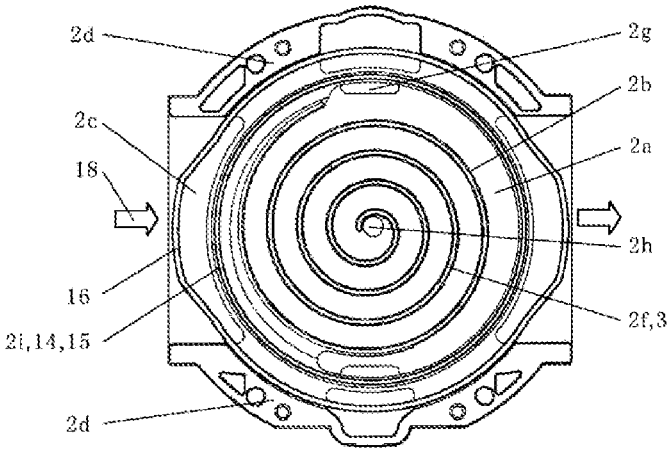
FIG. 4 is a front view showing a fixed scroll of the scroll-type fluid machine according to Example 1 hereof.

FIG. 4 is a front view showing a fixed scroll 2 to be described hereinlater.

A reference numeral 1 denotes a casing constituting an outer shell of the scroll-type compressor. The fixed scroll 2 generally includes: an end plate 2*a* which is disposed at an opening side of the casing 1 and substantially formed in a disk-like shape; a scroll-shaped lap part 2*b* axially upstanding from the end plate 2*a;* a flange 2*c* formed around the end plate 3*a* and opposed to the casing 1; a flange fastener 2*d* fastened to the casing 1; and a plurality of cooling fins 2*e* projected from a back side of the end plate 2*a*. A tip seal groove 2*f* extending in a winding direction is formed at a distal end of the lap part 2*b*. A tip seal 3 as a seal member in sliding contact with an end plate 4*a* of a revolving scroll 4 is disposed in the tip seal groove 2*f*.

The revolving scroll 4 generally includes: an end plate 4*a* which is pivotally mounted in the casing 1 and substantially formed in a disk-like shape; a scroll-shaped lap part 4*b* axially upstanding from the end plate 4*a;* a plurality of cooling fins 4*c* projected from a back side of the end plate 4*a;* and a back plate 4*d* fixedly located at a distal side of the cooling fin 4*c*. Formed at a distal end of the lap part 4*b* is a tip seal groove 4*e* extending in the winding direction. A tip seal 5 as a seal member in sliding contact with the end plate 2*a* of the fixed scroll is disposed in the tip seal groove 4*e*.

A driving shaft 6 is supported by a load side bearing 7 and a anti-load side bearing 8 in a manner to be rotatable relative to the casing 1 and includes an eccentric part 6*a* supported by a slewing bearing 9 in a manner to be rotatable relative to the back plate 4*d*. The driving shaft 6 is provided with a pulley 10 at an end thereof. The pulley 10 is connected to an output side of an electric motor (not shown) as a drive source by means of a belt (not shown), for example. It is noted here that a method of connecting the drive source such as the electric motor with the driving shaft 6 by means of a coupling or a method of integrally forming the drive source with the driving shaft of the fluid machine is also available.

A self-rotation preventing mechanism 11 is disposed between the back plate 4*d* and the casing 1 and includes, for example, a crankshaft and a bearing.

The revolving scroll 4 makes a revolving motion as driven by the driving shaft 6 and the self-rotation preventing mechanism 11 so as to compress a plurality of compression chambers 12 toward the center thereof, the compression chambers defined by the lap part 4*a* and the lap part 2*a* between the revolving scroll and the fixed scroll 2. Thus, the outside air is sucked into the compression chambers 12 from an inlet port 2*g* disposed on the outer side from the lap part 2*a* on the fixed scroll 2 and through an inlet filter 13. The air under pressure is discharged from an outlet port 2*h* disposed at the center of the fixed scroll 2.

A face seal groove 2*i* is annularly formed on an inside diameter side of the flange 2*c* of the fixed scroll 2 in opposed relation with the end plate 4*a* of the revolving scroll 4. An annular face seal 14 is disposed in the face seal groove 2*i*. The face seal 14 is held in sliding contact with the end plate 4*a* of the revolving scroll 4 by means of, for example, a tubular back-up tube 15. The inside the face seal 14 defines a space communicating the inlet port 2*g* and the compression chambers 12. Namely, the inside of the face seal 14 is at a negative pressure relative to the outside during the operation of the compressor. By virtue of the above-described pressure difference between the inside and the outside of the face seal, the face seal 14 is adapted to prevent the external dust reaching the face seal 14 from invading the inside thereof and further invading the compression chambers 12.

A shield part 16 is formed on the flange 2*c* of the fixed scroll 2 at place radially outward of the face seal 14. A distal end of the shield part does not axially protrude beyond a proximal end of the cooling fins 4*c* of the revolving scroll 4.

A cooling fan 17 is mounted to an end of the driving shaft and generates cooling air 18 by making a rotation motion jointly with the driving shaft. The cooling air 18 flows along a duct 19 to be distributed to the inside of the casing 1, the cooling fins 2*e* of the fixed scroll 2 and the cooling fins 4*c* of the revolving scroll 4 for cooling the casing 1, the fixed scroll 2, the revolving scroll 4 and the like which are warmed by the heat of compression.

Figure 5:
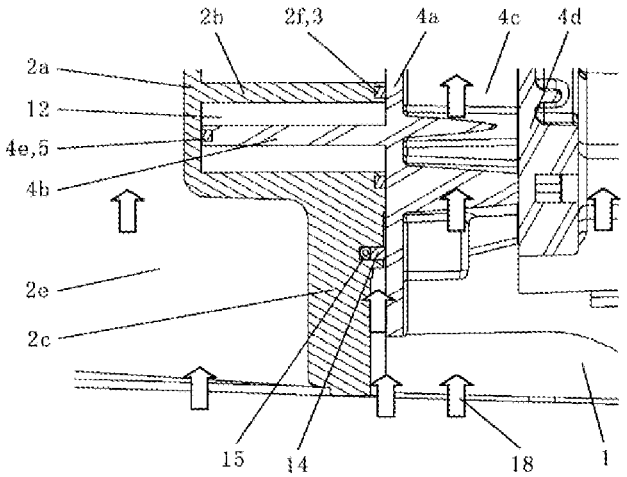
FIG. 5 is an enlarged view showing an area around a face seal of a conventional scroll-type fluid machine.
Figure 6:
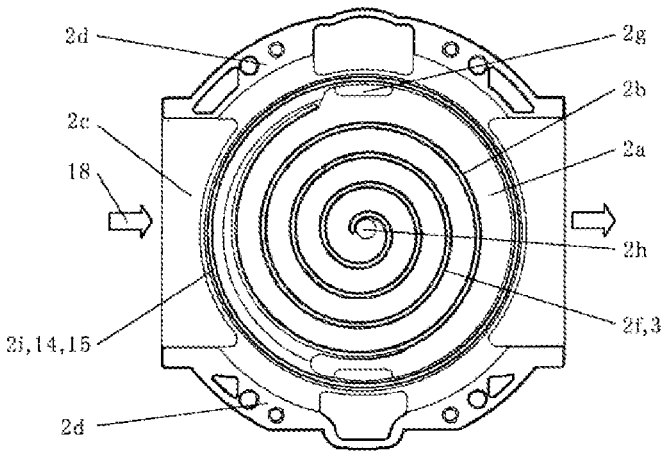
FIG. 6 is a front view showing a fixed scroll of the conventional scroll-type fluid machine.

The inhibition of the dust invasion into the compression chambers 12 by the shield part 16 of the example is described by way of comparison with a conventional structure shown in FIG. 5 and FIG. 6.

FIG. 5 is an enlarged view showing an area around a face seal of a conventional scroll-type fluid machine. FIG. 6 is a front view showing a fixed scroll 2 of the conventional scroll-type fluid machine. In the figures, identical or equivalent components to those of FIGS. 1, 2, 3 and 4 are referred to by like reference numerals, the description of which is dispensed with. As described above, the face seal 14 prevents the external dust from invading the compression chambers 12. However, a seal surface of the face seal 14 is not in a hermetically sealed state because the seal surface is constantly in sliding contact with the end plate 4*a* of the revolving scroll 4. Particularly in an environment where the cooling air 18 flows around the face seal, therefore, it is impossible to completely prevent the external dust reaching the face seal 14 from invading the compression chambers 12. The dust reaching the face seal 14 accelerates the wear of the face seal 14. Further, the dust invading the compression chambers 12 through the face seal 14 accelerates the wear of the tip seals 3, 5 and of the sliding surfaces of the end plates 2*a,* 4*a* with the tip seals 3, 5. The wear of the face seal 14 leads to further invasion of the dust into the compression chambers 12 while the wear of the tip seals 3, 5 and the end plates 2*a,* 4*a* leads to leakage of compression air between the plural compression chambers 12. These wears have resulted in the reliability degradation of the compressor.

According to the example, on the other hand, the shield part 16 is provided at place radially outward of the face seal 14. The example is adapted to prevent the dust contained in the outside air from reaching the face seal 14 and further invading the compression chambers 12. Accordingly, the wear of the tip seals 3, 5, the end plates 2*a,* 4*a* and the face seal 14 of the above-described conventional scroll-type fluid machine is prevented. Further, the example does not interfere with the flow of the cooling air 18 into the cooling fins 4*c* because the distal end of the shield part 16 does not protrude beyond the proximal end of the cooling fins 4*c* of the revolving scroll 4.

According to Japanese Patent Application Laid-Open No. 2005-307770 (PTL 1), the face seal has its terminal end doubled and fitted in the dust seal groove such that the face seal is improved in the seal performance at the end thereof. However, this structure is not equipped with the measure against the external dust reaching the face seal. The problem about the external dust invading through the seal surface or the problem about the wear of the face seal itself caused by the dust has not been solved. There could be a way to prevent the invasion of the dust into the compression chambers by enhancing the seal performance of the face seal by changing the configuration of the face seal and the configuration of the back-up tube for pressing the face seal. However, these parts heretofore have such simple configurations that it is not easy to change these configurations. These parts have a problem with productivity.

According to the example as described above, the amount of dust reaching the face seal 14 is reduced by providing the shield part 16 while the compressor can be enhanced in reliability without degrading the productivity.

EXAMPLE 2

Figure 7:
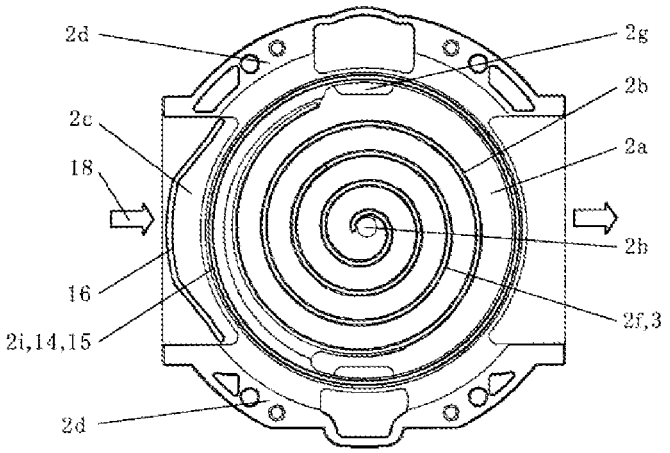
FIG. 7 is a front view showing a fixed scroll of a scroll-type fluid machine according to Example 2 hereof.

Example 2 of the present invention is described with reference to FIG. 7. Identical or equivalent components to those of Example 1 are referred to by like reference numerals, the description of which is dispensed with. In the same fluid machine as that of Example 1, Example 2 is featured by the shield part 16 that is disposed at place radially outward of the face seal 14 and on an upstream side of the cooling air 18. The shield part is not disposed on a downstream side of a cooling air passage. In this example, the amount of dust reaching the face seal 14 is reduced by providing the shield part 16 at place on the upstream side where the cooling air 18 containing the dust flows toward the face seal 14.

As just described, this example can achieve not only the effects set forth in Example 1 but also an increased productivity by reducing the area provided with the shield part 16.

EXAMPLE 3

Figure 8:
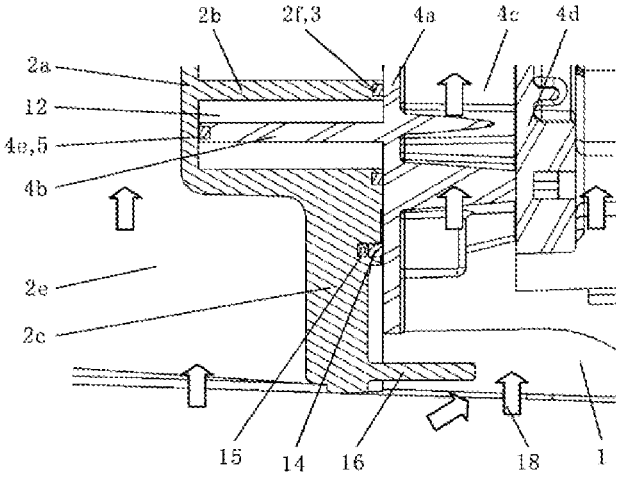
FIG. 8 is an enlarged view showing an area around a face seal of a scroll-type fluid machine according to Example 3 hereof.

Example 3 of the present invention is described with reference to FIG. 8. Identical or equivalent components to those of Example 1 are referred to by like reference numerals, the description of which is dispensed with. In the same fluid machine as that of Example 1, Example 3 has features that the distal end of the shield part 16 axially protrudes beyond the proximal ends of the cooling fins 4*c* of the revolving scroll 4 but does not axially protrude beyond distal ends of the cooling fins 4*c* of the revolving scroll 4. In this example, an axial distance between the flow of the cooling air 18 and the face seal 14 is longer than that of Example 1 and hence, the amount of dust reaching the face seal 14 is reduced further. Hence, the amount of dust reaching the face seal 14 is reduced further than in Example 1. Further, a part of the cooling air 18 flows into the cooling fins 4*c* and hence, a cooling effect of the revolving scroll 4 is not lost.

As just described, this example can enhance the effects set forth in Example 1.

EXAMPLE 4

Figure 9:
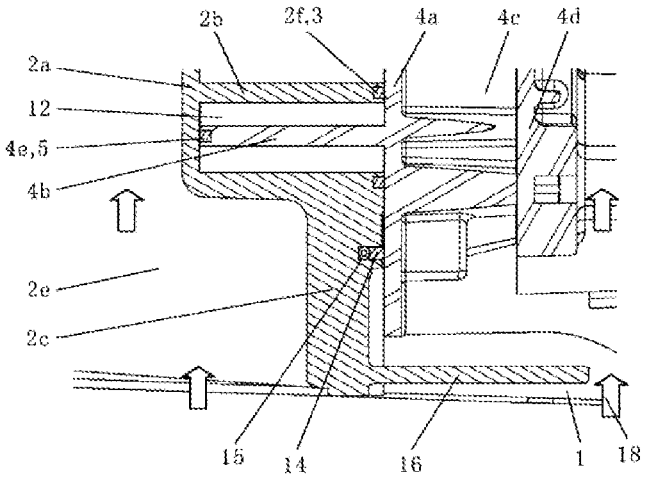
FIG. 9 is an enlarged view showing an area around a face seal of a scroll-type fluid machine according to Example 4 hereof.

Example 4 of the present invention is described with reference to FIG. 9. Identical or equivalent components to those of Example 1 are referred to by like reference numerals, the description of which is dispensed with. In the same fluid machine as that of Example 1, Example 4 has features that the distal end of the shield part 16 axially protrudes beyond the distal ends of the cooling fins 4*c* of the revolving scroll 4. In this example, the axial distance between the flow of the cooling air 18 and the face seal 14 is longer than that of Example 1 and hence, the amount of dust reaching the face seal 14 is reduced further.

On the other hand, the shield part blocks the flow of the cooling air 18 into the cooling fins 4*c*. Therefore, the example is suited to an application that does not require a large amount of cooling air 18 for cooling the revolving scroll 4. For example, the example is adapted to use for low pressure compression, vacuum pump or the like.

As just described, this example can enhance the effects set forth in Example 1.

EXAMPLE 5

Figure 10:
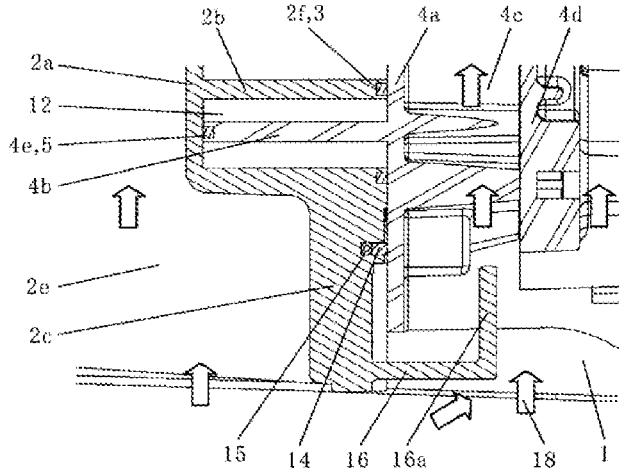
FIG. 10 is an enlarged view showing an area around a face seal of a scroll-type fluid machine according to Example 5 hereof.

Example 5 of the present invention is described with reference to FIG. 10. Identical or equivalent components to those of Example 1 are referred to by like reference numerals, the description of which is dispensed with. In the same fluid machine as that of Example 1, Example 5 has features that the shield part 16 includes a bent portion 16*a* and that a part of the shield part 16 is located radially inward of the end plate 4*a* of the revolving scroll 4. In this example, as compared to Example 1, the cooling air 18 passing the shield part 16 flows along the bent portion 16*a* so as to be prevented from moving around to the shield part 16. Therefore, the amount of dust reaching the face seal 14 is reduced further.

As just described, this example can enhance the effects set forth in Example 1.

EXAMPLE 6

Figure 11:
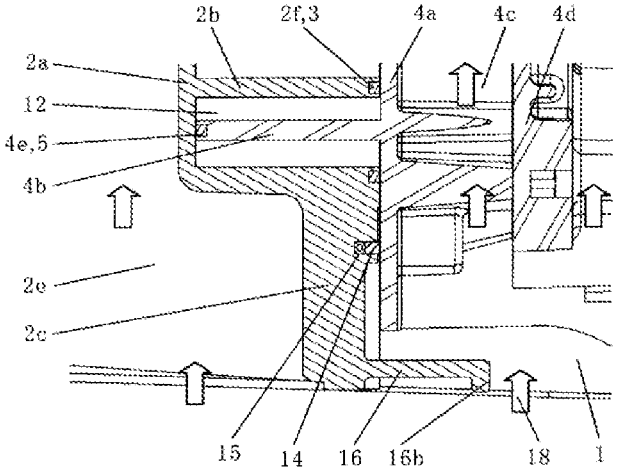
FIG. 11 is an enlarged view showing an area around a face seal of a scroll-type fluid machine according to Example 6 hereof.

Example 6 of the present invention is described with reference to FIG. 11. Identical or equivalent components to those of Example 1 are referred to by like reference numerals, the description of which is dispensed with. In the same fluid machine as that of Example 1, Example 6 has a feature that the shield part 16 includes a dust capturing portion 16*b* which is radially bent to an outside circumference. In this example, as compared to Example 1, the dust capturing portion 16*b* allows the dust contained in the cooling air to accumulate therein and hence, the amount of dust reaching the face seal 14 is reduced further.

As just described, this example can enhance the effects set forth in Example 1.

EXAMPLE 7

Figure 12:
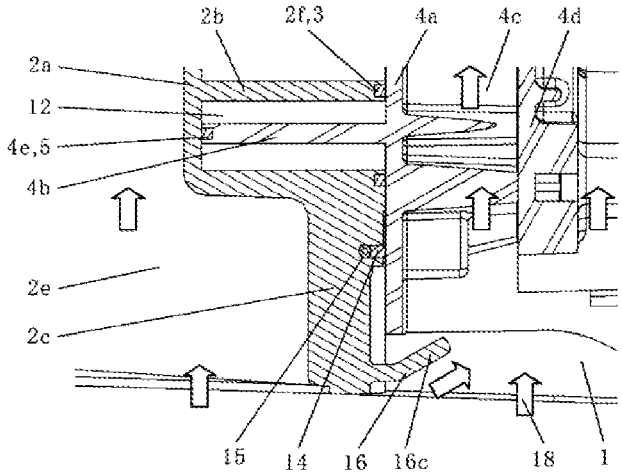
FIG. 12 is an enlarged view showing an area around a face seal of a scroll-type fluid machine according to Example 7 hereof.

Example 7 of the present invention is described with reference to FIG. 12. Identical or equivalent components to those of Example 1 are referred to by like reference numerals, the description of which is dispensed with. In the same fluid machine as that of Example 1, Example 6 has a feature that the shield part 16 includes an inclined portion 16*c* radially inclined toward the inside. Incidentally, a configuration may also be made such that a part of the shield part such as the inclined portion 16*c* is located radially inwardly of an outer periphery of the revolving scroll during at least a part of the period of the revolving motion of the revolving scroll. In this example, as compared to Example 1, the cooling air 18 is not blocked from flowing but prevented from swirling when reaching the shield part 16. Accordingly, the example suppresses noises due to the generation of swirl.

Further, the dust is prone to flow along the inclined portion 16*c* and hence, a work for removing the accumulated dust becomes unnecessary. This also leads to improved maintainability.

As just described, this example not only achieves the effects set forth in Example 1 but also achieves noise reduction and improved maintainability.

EXAMPLE 8

Figure 13:
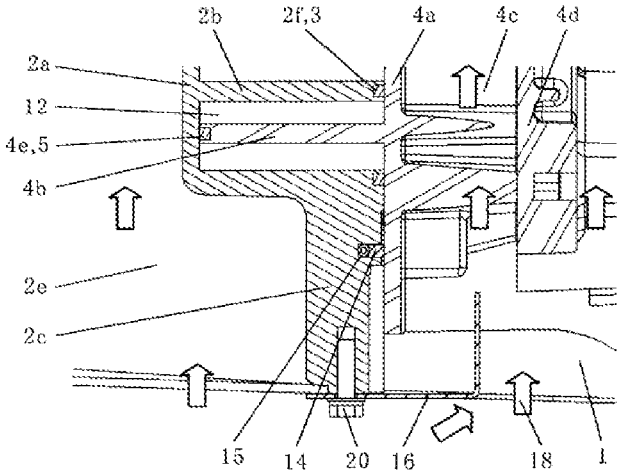
FIG. 13 is an enlarged view showing an area around a face seal of a scroll-type fluid machine according to Example 8 hereof.

Example 8 of the present invention is described with reference to FIG. 13. Identical or equivalent components to those of Example 1 are referred to by like reference numerals, the description of which is dispensed with. In the same fluid machine as that of Example 1, Example 8 has a feature that the shield part 16 is removably assembled by using a threaded fastener 20 or the like. In this example, as compared to Example 1, the shield part 16 can be assembled after the compressor is completed, which leads to improved assemblability. Further, the example achieves improved productivity because whether or not the shield part 16 is necessary or the configuration of the shield part can be determined depending upon the presence of dust in the operating environment of the compressor or the application of the compressor.

As just described, this example not only achieves the effects set forth in Example 1 but also achieves improved assemblability and productivity by configuring the shield part 16 to be removably assembled.

EXAMPLE 9

Figure 14:
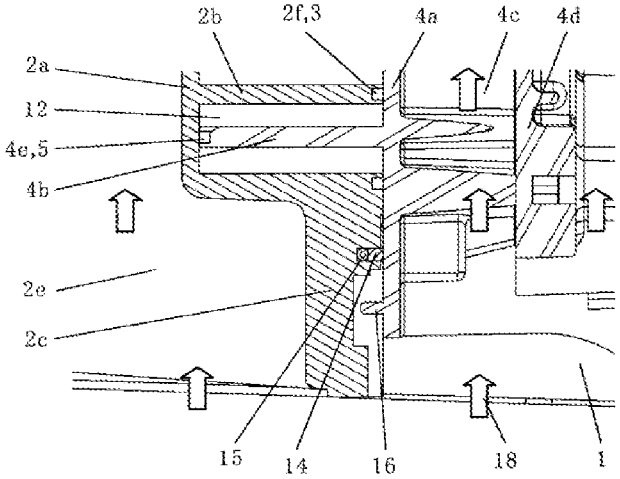
FIG. 14 is an enlarged view showing an area around a face seal of a scroll-type fluid machine according to Example 9 hereof.

Example 9 of the present invention is described with reference to FIG. 14. Identical or equivalent components to those of Example 1 are referred to by like reference numerals, the description of which is dispensed with. In the foregoing examples, the shield part 16 is mounted to the fixed scroll 2. In the same fluid machine as that of Example 1, however, Example 9 has a feature that the shield part 16 is mounted to the revolving scroll 4. As shown in FIG. 14, the flange 2*c* of the fixed scroll 2 is formed with a recess, in which the shield part 16 mounted to the end plate 4*a* of the revolving scroll 4 is located. In this example, as compared to Example 1, the flange 2 of the fixed scroll is formed with the recess in which the shield part 16 mounted to the end plate 4*a* of the revolving scroll 4 is located and hence, the amount of dust reaching the face seal 14 is reduced further.

Figure 15:
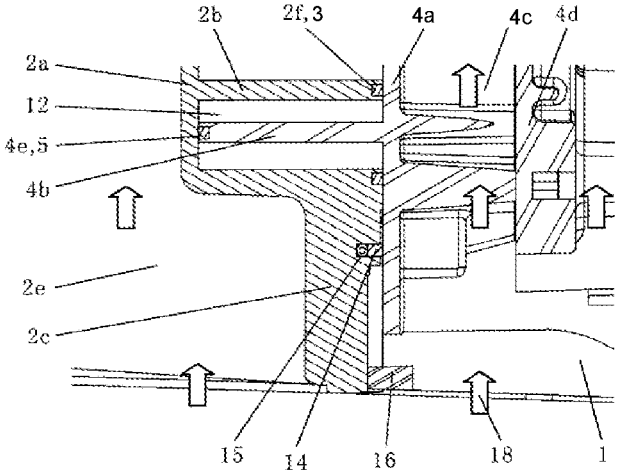
FIG. 15 is an enlarged view showing an area around a face seal according to a modification of Example 9 hereof.

As just described, this example can achieve not only the effects set forth in Example 1 but also further reduction of the amount of dust reaching the face seal 14. It is noted that the shield part 16 may be disposed at the casing 1 as illustrated by a modification of FIG. 15. Alternatively, the shield part may also be disposed at the duct 19.

The foregoing examples have configurations where the cooling fan 17 is mounted to the compressor and generates the cooling air 18 as rotating in conjunction with the rotation of the driving shaft 6. However, the cooling fan may be driven independently from the driving shaft 6. Alternatively, the cooling fan may also be provided externally of the compressor. Further, the shield part 16 may have a net-like structure such as to allow the cooling air 18 alone to pass therethrough while inhibiting the passage of the dust. What is more, the features of the individual examples may be implemented in combination.

While the foregoing examples have been described by way of example of the scroll-type air compressor as the fluid machine, the present invention is not limited to this and is applicable to other scroll-type fluid machines such as vacuum pumps and expanders.

Each of the examples that have been described herein is merely illustrative of an example of carrying out the present invention and the technical scope thereof is not limited by these examples. That is, the present invention can be carried out in various modes without departing from the technical idea or essential features thereof.

REFERENCE SIGNS LIST

1 . . . casing
2 . . . fixed scroll
2*a* . . . end plate of fixed scroll
2*b* . . . lap part of fixed scroll
2*c* . . . flange
2*d* . . . flange fastener
2*e* . . . cooling fins of fixed scroll
2*f* . . . tip seal groove of fixed scroll
2*g* . . . inlet port
2*h* . . . outlet port
2*i* . . . face seal groove
3 . . . tip seal
4 . . . revolving scroll
4*a* . . . end plate of revolving scroll
4*b* . . . lap part of revolving scroll
4*c* . . . cooling fins of revolving scroll
4*d* . . . back plate
4*e* . . . tip seal groove of revolving scroll
5 . . . tip seal
6 . . . driving shaft
6*a* . . . eccentric part
7 . . . load side bearing
8 . . . anti-load side bearing
9 . . . slewing bearing
10 . . . pulley
11 . . . self-rotation preventing mechanism
12 . . . compression chamber
13 . . . inlet filter
14 . . . face seal
15 . . . back-up tube
16 . . . shield part
16*a* . . . bent portion
16*b* . . . dust capturing portion
16*c* . . . inclined portion
17 . . . cooling fan
18 . . . cooling air
19 . . . duct
20 . . . threaded fastener

The invention claimed is:

1. A scroll-type fluid machine comprising:

a revolving scroll which includes an end plate and a lap part disposed at the end plate, and makes a revolving motion;

a fixed scroll which includes an end plate, a lap part disposed at the end plate and forming a compression chamber between itself and the lap part of the revolving scroll, and a flange opposed to the end plate of the revolving scroll; and a face seal disposed between the flange of the fixed scroll and the end plate of the revolving scroll and sealing a clearance between the fixed scroll and the revolving scroll, wherein a shield part is provided for preventing dust from reaching the face seal from outside in a radial direction, and wherein the shield part is formed on the flange at a location radially outward of the revolving scroll, and the shield part protrudes in a direction away from the flange.

2. The scroll-type fluid machine according to claim 1, wherein the revolving scroll includes a cooling fin on the opposite side of the end plate thereof from that formed with the lap part, and a distal end of the shield part protrudes from the end plate of the revolving scroll from that formed with the lap part in a direction away from the flange but does not protrude beyond a proximal end of the cooling fin.

3. The scroll-type fluid machine according to claim 1, wherein the revolving scroll includes a cooling fin on the opposite side of the end plate thereof from that formed with the lap part, and a distal end of the shield part protrudes beyond a proximal end of the cooling fin in a direction away from the flange but does not protrude beyond a distal end of the cooling fin.

4. The scroll-type fluid machine according to claim 1, wherein the revolving scroll includes a cooling fin on the opposite side of the end plate thereof from that formed with the lap part, and a distal end of the shield part protrudes beyond a distal end of the cooling fin in a direction away from the flange.

5. The scroll-type fluid machine according to claim 1, wherein a cooling air passage for distribution of cooling air is formed on the opposite side of the end plate of the revolving scroll from that formed with the lap part, while the shield part is located at place to block a space between an upstream of the cooling air passage and the face seal, and the shield part is not disposed on a downstream side of the cooling air passage with respect to the face seal.

6. The scroll-type fluid machine according to claim 1, wherein the shield part is configured to be removable from the revolving scroll or the fixed scroll.

7. The scroll-type fluid machine according to claim 1, wherein the shield part includes a bent portion.

8. The scroll-type fluid machine according to claim 7, wherein a distal portion from the bent portion of the shield part is inclined radially inwardly.

9. The scroll-type fluid machine according to claim 8, wherein during at least a part of the period of the revolving motion of the revolving scroll, a part of the shield part is located radially inwardly of an outer periphery of the revolving scroll.

10. A scroll-type fluid machine comprising:

a revolving scroll which includes an end plate and a lap part disposed at the end plate, and makes a revolving motion;

a fixed scroll which includes an end plate, a lap part disposed at the end plate and forming a compression chamber between itself and the lap part of the revolving scroll, and a flange opposed to the end plate of the revolving scroll; and a face seal disposed between the flange of the fixed scroll and the end plate of the revolving scroll and sealing a clearance between the fixed scroll and the revolving scroll, wherein a shield part is provided for preventing dust from reaching the face seal from outside in a radial direction, and wherein the flange is formed with a recess, while a distal end of the shield part formed at the revolving scroll is located in the recess.

11. The scroll-type fluid machine according to claim 10, wherein the shield part is configured to be removable from the revolving scroll or the fixed scroll.

12. A scroll-type fluid machine comprising:

a revolving scroll which includes an end plate and a lap part disposed at the end plate, and makes a revolving motion;

a fixed scroll which includes an end plate, a lap part disposed at the end plate and forming a compression chamber between itself and the lap part of the revolving scroll, and a flange opposed to the end plate of the revolving scroll; and a face seal disposed between the flange of the fixed scroll and the end plate of the revolving scroll and sealing a clearance between the fixed scroll and the revolving scroll, wherein a cooling air passage for distribution of cooling air is formed on the opposite side of the end plate of the revolving scroll from that formed with the lap part, and wherein a shield part is provided at a location radially outward of the revolving scroll and on the surface of the flange of the fixed scroll with the face seal at place radially outward from the face seal or at place laterally of the flange, and the shield part protrudes in a direction away from the surface of the flange.

13. The scroll-type fluid machine according to claim 12, wherein the revolving scroll includes a cooling fin on the opposite side of the end plate thereof from that formed with the lap part, while a distal end of the shield part protrudes from the end plate of the revolving scroll from that formed with the lap part in a direction away from the flange but does not protrude beyond a proximal end of the cooling fin in a direction away from the flange.

14. The scroll-type fluid machine according to claim 12, wherein the revolving scroll includes a cooling fin on the opposite side of the end plate thereof from that formed with the lap part, while a distal end of the shield part protrudes beyond a proximal end of the cooling fin in a direction away from the flange but does not protrude beyond a distal end of the cooling fin.

15. The scroll-type fluid machine according to claim 12, wherein the revolving scroll includes a cooling fin on the opposite side of the end plate thereof from that formed with the lap part, while a distal end of the shield part protrudes beyond a distal end of the cooling fin in a direction away from the flange.

16. The scroll-type fluid machine according to claim 12, wherein the shield part is located at place to block a space between an upstream of the cooling air passage and the face seal, and the shield part is not disposed on a downstream side of the cooling air passage with respect to the face seal.

17. The scroll-type fluid machine according to claim 12, wherein the shield part is configured to be removable from the revolving scroll or the fixed scroll.

18. The scroll-type fluid machine according to claim 12, wherein the shield part includes a bent portion.

19. The scroll-type fluid machine according to claim 18, wherein a distal portion from the bent portion of the shield part is inclined radially inwardly.

20. The scroll-type fluid machine according to claim 19, wherein during at least a part of the period of the revolving motion of the revolving scroll, a part of the shield part is locatedradially inwardly of an outer periphery of the revolving scroll.

* * * * *